US009989061B2

(12) United States Patent
Franieck et al.

(10) Patent No.: US 9,989,061 B2
(45) Date of Patent: Jun. 5, 2018

(54) GEOMETRY FOR THE COMPENSATION OF AXIAL GAPS ARISING IN ELECTRIC PUMPS

(71) Applicant: Robert Bosch GmbH, Stuttgart (DE)

(72) Inventors: Erwin Franieck, Campinas (BR); Joerg Sigrist, Blaj (RO); Bernd Osswald, Ludwigsburg (DE); Eric Plantier, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 302 days.

(21) Appl. No.: 14/653,320

(22) PCT Filed: Oct. 17, 2013

(86) PCT No.: PCT/EP2013/071702

§ 371 (c)(1),
(2) Date: Jun. 18, 2015

(87) PCT Pub. No.: WO2014/095118

PCT Pub. Date: Jun. 26, 2014

(65) Prior Publication Data

US 2015/0322950 A1 Nov. 12, 2015

(30) Foreign Application Priority Data

Dec. 18, 2012 (DE) ..... 10 2012 223 592

(51) Int. Cl.
*F04D 13/06* (2006.01)
*F04D 29/40* (2006.01)
(Continued)

(52) U.S. Cl.
CPC ..... *F04D 13/06* (2013.01); *F04D 29/40* (2013.01); *F04D 29/406* (2013.01); *F04D 29/60* (2013.01); *F04D 29/628* (2013.01)

(58) Field of Classification Search
CPC .. F04C 15/00; F04C 15/0003; F04C 15/0034; F04C 2/3445; F04B 17/03;
(Continued)

(56) References Cited

U.S. PATENT DOCUMENTS 3,192,861 A * 7/1965 Haegh ..... H02K 5/128 310/52
4,250,423 A * 2/1981 Linscott, Jr. ..... H02K 1/185 310/216.124
(Continued)

FOREIGN PATENT DOCUMENTS

CN 2332509 Y 8/1999
CN 101165335 A 4/2008
(Continued)

OTHER PUBLICATIONS

International Search Report for Application No. PCT/EP2013/071702 dated Mar. 12, 2014 (English Translation, 2 pages).

*Primary Examiner* — Alexander Comley
*Assistant Examiner* — Benjamin Doyle
(74) *Attorney, Agent, or Firm* — Michael Best & Friedrich LLP

(57) ABSTRACT

The invention proposes an electric pump (1) for delivering a fluid. The electric pump (1) has a first pump component (3) with a first interface (7) and has a second pump component (5). The first pump component (3) and the second pump component (5) are in contact with one another at the first interface (7). Here, the first interface (7) has an incline (11) with respect to a plane running perpendicular to a longitudinal axis (13) of the electric pump (1).

7 Claims, 3 Drawing Sheets

(51) Int. Cl.
*F04D 29/60* (2006.01)
*F04D 29/62* (2006.01)

(58) Field of Classification Search
CPC .... F04B 1753/16; F04D 13/06; F04D 29/406; F04D 29/426; F04D 29/4293; F04D 29/628
USPC .... 310/85, 86, 88, 89, 91; 417/423.1, 423.7, 417/423.11, 423.14
See application file for complete search history.

(56) References Cited

U.S. PATENT DOCUMENTS 4,362,480 A * 12/1982 Suzuki ..... F04C 11/008 418/152
4,797,071 A * 1/1989 Veyrat ..... F04C 29/005 417/410.3
5,051,642 A * 9/1991 Hediger ..... H02K 3/505 310/260
5,585,682 A * 12/1996 Konicek ..... H02K 1/185 310/216.114
6,099,261 A * 8/2000 Worden ..... F04C 2/3445 417/204
6,142,030 A * 11/2000 Nagai ..... B23Q 1/25 198/750.7
6,276,908 B1 8/2001 Batchelder et al.
7,429,810 B2 * 9/2008 Ueda ..... H02K 3/50 310/43
2005/0074345 A1 4/2005 Deichmann et al.
2005/0115055 A1 * 6/2005 Kimura ..... F01C 21/10 29/596
2005/0285456 A1 * 12/2005 Amagi ..... H02K 5/08 310/43
2006/0071564 A1 * 4/2006 Stewart ..... H02K 1/185 310/89
2006/0181168 A1 * 8/2006 Hargraves ..... F04B 17/03 310/90
2006/0250754 A1 11/2006 Schlosser
2007/0001529 A1 * 1/2007 Takahashi ..... H02K 5/10 310/88
2007/0152524 A1 * 7/2007 Sims, Jr. ..... H02K 5/15 310/89
2007/0159022 A1 * 7/2007 Lung ..... F16D 1/108 310/216.008
2007/0247009 A1 * 10/2007 Hoffman ..... F04D 25/0606 310/51
2010/0021282 A1 1/2010 Geissel
2010/0172776 A1 7/2010 Fischer et al.
2011/0006628 A1 * 1/2011 Ogino ..... H02K 5/15 310/89
2011/0058966 A1 * 3/2011 Cunningham ..... F04D 13/10 417/410.1
2012/0025636 A1 * 2/2012 Roopnarine ..... H02K 1/02 310/46
2013/0195545 A1 * 8/2013 Tsuchida ..... F16H 48/40 403/270
2015/0322950 A1 * 11/2015 Franieck ..... F04D 29/406 417/423.15

FOREIGN PATENT DOCUMENTS

CN 201568181 U 9/2010
CN 102425613 A 4/2012
DE 10341837 3/2005
DE 102006053933 5/2008
DE 102007025510 12/2008
DE 102007030706 1/2009
DE 102009008792 8/2010
GB 2053339 B 6/1983

* cited by examiner

GEOMETRY FOR THE COMPENSATION OF AXIAL GAPS ARISING IN ELECTRIC PUMPS

BACKGROUND OF THE INVENTION

Pumps can be used in many areas of technology to convey fluids. A pump can include components such as for example an electric motor and a pump stage. The components are arranged in a common housing. The components are stressed against one another while closing the housing for example by means of a flanging, beading or rolling process.

The components that are arranged in the interior of the pump can be embodied from different materials so that it is possible over the serviceable life of a pump for the components to settle. The inner pre-stressing arrangement of the components against one another is lost. In addition, the components can loosen from one another as a result of temperature changes and as a result of different coefficients of thermal expansion.

SUMMARY OF THE INVENTION

A requirement for an improved electric pump and a production method for a corresponding electric pump can be in particular to render it possible to avoid a loosening of components of the electric pump.

In accordance with a first aspect of the invention, an electric pump for conveying a fluid is proposed. The electric pump comprises a first pump component and a second pump component. At least one first contact surface is provided on the first pump component. The first pump component and the second pump component are in contact with one another at the first contact surface. The first contact surface comprises an incline with respect to a plane that extends perpendicularly to a longitudinal axis of the electric pump.

In other words, the idea of the present invention is based on providing an incline or rather gradient in regions in which components of the electric pump are in contact with one another so that if a gap is present between the components, the components can be rotated with respect to one another and as a consequence, the gap can be closed. The incline is embodied in such a manner that the surface of the contact surface includes an angle with respect to a plane that extends perpendicularly to a longitudinal axis of the electric pump. The rotation can for example be caused by means of a torque that is generated by one of the components. In particular, one of the components can generate the torque or can be connected to a torque generator in a non-rotatable manner. The other component can generate a counter torque in that said component is fixed to where necessary non-moving components of the electric pump.

In this manner, it is possible to prevent an axial gap from forming between the components of the electric pump. As a result of different materials and different coefficients of thermal expansion of the components, axial gaps that arise are closed due to the incline and the torque of one of the components. As a consequence, it is possible to avoid leakage sites within the pump. In addition, a reliable functionality of the pump is ensured due to the constant overall length of the components of the electric pump in the axial direction.

The electric pump can be used to convey different fluids or rather media such as for example fuel or windscreen washing fluid. In particular, the electric pump can be used in motor vehicles for example as an electric fuel pump (EFP).

The electric pump can for example be embodied as a side duct pump or a roller cell pump component having an electric motor.

The first pump component can be an inner component of the electric pump, such as for example a motor part or rather a motor housing. In particular, the first pump component can be an electric motor around which a synthetic material is injection molded. The electric motor can comprise a stator, a rotor that is mounted in the stator in a rotatable manner and a shaft. Alternatively, the first pump component can be embodied as a connecting cover of the electric pump. In addition, the first pump component can be an intermediate housing or a suction cover of the electric pump.

The second pump component can be for example any inner component of the electric pump that is in contact with the first pump component in an arbitrary manner. If the first pump component is embodied for example as a connecting cover, the second pump component can thus be embodied as an electric motor or rather as a housing of the electric motor. If the first pump component is embodied as an electric motor, the second pump component can thus be embodied as a connecting cover or as an intermediate housing. In addition, if the first pump component is embodied for example as an intermediate housing, the second pump component can thus be embodied as a suction cover or as an electric motor.

The first pump component comprises at least one first contact surface. In particular, the first pump component can comprise multiple first contact surfaces. The first contact surfaces define contact points or rather contact surfaces between the first pump component and the second pump component. One or multiple corresponding second contact surfaces can be provided in a corresponding manner on the second pump component.

The first contact surface comprises an incline or rather a shallow gradient with respect to a cross-sectional surface that extends perpendicularly to a longitudinal axis of the electric pump. The longitudinal axis of the electric pump extends for example parallel to a shaft of the electric motor. In other words, the surface of the contact surface includes an angle with respect to the described plane. The second contact surface comprises a surface having a considerably uniform gradient with respect to the same plane. In this manner, the first and the second pump component can be rotated with respect to one another in a manner similar to a screw so that the overall length of the pump components remains constant along the longitudinal axis even in the case of expansion and compression of the different materials of the pump components.

In accordance with one exemplary embodiment of the invention, the first pump component is embodied to generate, exert or rather to transfer a torque. The torque causes the first pump component to rotate with respect to the second pump component.

In the case of this exemplary embodiment, the first pump component can be embodied as an electric motor that generates a torque. The second pump component can be an intermediate housing that is arranged between the electric motor and a pump stage. If an axial gap is present between the electric motor and the intermediate housing, these pump components are thus not fixed in relation to one another. As a result of the torque that is exerted by the first pump component, the pump components rotate with respect to one another along the first and the second contact surface until the friction between said components is sufficiently high as a result of the incline so that the pump components are fixed with respect to one another.

In accordance with a further exemplary embodiment of the invention, the torque and the presence and the orientation of the incline mean that an overall length of the first pump component and the second pump component is constant along a longitudinal axis of the electric pump.

In this manner, the pump components are fixed in relation to one another in the pump housing. In addition, as a consequence, it is possible to produce a sealing arrangement of the individual pump components. If the intermediate housing is fixed for example in relation to the pump stage and in relation to the electric motor, an axial gap is therefore not present between the pump components and the medium that is to be conveyed cannot penetrate into regions of the electric motor.

In accordance with a further exemplary embodiment of the invention, the incline of the first contact surface includes an angle of maximal 10° with respect to the plane that extends perpendicularly to the longitudinal axis of the electric pump. This angle can be described as the angle of inclination. In particular, the angle of inclination amounts to maximal 5° and preferably maximal 2°. As a consequence, in the case of pump components that rotate with respect to one another, a self-locking arrangement can arise between the first and the second contact surface.

In accordance with a further exemplary embodiment of the invention, the incline is embodied in such a manner that in the case of a rotation of the first pump component with respect to the second pump component, a frictional lock occurs between the first and the second contact surface. The frictional lock can be supported by means of the geometric design, in other words for example by means of a shallow incline at the contact surfaces and by means of a corresponding material choice. The surfaces of the contact surfaces can comprise a material having a high coefficient of friction or rather having a high friction coefficient. By way of example, the coefficient of friction of the first contact surface and the second contact surface can be in particular at least 0.3, in particular at least 0.5 and preferably at least 0.7.

In particular, the angle of inclination of the incline, in other words the angle between the incline and the plane that extends perpendicularly to the longitudinal axis of the electric pump can be smaller than the frictional angle of the material of the first contact surface and the second contact surface. The drive direction and the friction coefficients of the first pump component and the second pump component can be selected in such a manner that a rotation of the pump components with respect to one another leads to a self-locking arrangement.

In accordance with a further exemplary embodiment of the invention, the second pump component comprises a second contact surface having an incline that corresponds to the first contact surface. By way of example, the second contact surface can be embodied in such a manner that the first contact surface lies flat on the second contact surface and where necessary without intermediate spaces.

In accordance with a further exemplary embodiment of the invention, the first pump component is embodied as a housing of an electric motor or rather as an electric motor itself. The second pump component is embodied as an intermediate housing. The second pump component is arranged between the electric motor and a pump wheel. The pump wheel can also be described as a running wheel or as a pump stage.

In accordance with a further exemplary embodiment of the invention, the first pump component is embodied as a housing of the electric motor or rather as an electric motor itself. The second pump component is embodied as a connecting cover.

In accordance with a second aspect of the invention, a method for producing an above described electric pump is proposed. The method comprises the following steps: providing a first pump component having a first contact surface, providing a second pump component, arranging the pump components along a longitudinal axis of the electric pump in such a manner that the first pump component and the second pump component are in contact with one another at the first contact surface, and providing the first contact surface having an incline with respect to a plane that extends perpendicularly to the longitudinal axis of the electric pump.

The sequence of the steps can vary. For example, the first contact surface can initially be provided with an incline and can be subsequently arranged in the pump housing along a longitudinal axis of the electric pump. In addition, the method can comprise further steps such as for example injection molding around the first pump component using synthetic material, in particular if this first pump component is embodied as an electric motor.

In accordance with a third aspect of the invention, a motor is proposed that generates an output torque. The motor comprises a first motor part having a first contact surface. In addition, the motor comprises a second motor part. The first motor part and the second motor part are in contact with one another at the first contact surface. The first contact surface comprises an incline with respect to a plane that extends perpendicularly to a longitudinal axis of the motor.

The features and considerations that are described in connection with the electric pump also apply in a similar manner to the motor. In general, the design of the electric pump having an incline at a contact surface so as to close undesired axial gaps by means of a torque can be transferred to further devices in which the output torque of the motor is used to drive something.

BRIEF DESCRIPTION OF THE DRAWINGS

Further features and advantages of the present invention are evident to the person skilled in the art in the description hereinunder of exemplary embodiments with reference to the attached drawings and said exemplary embodiments are not designed as limiting the invention.

DETAILED DESCRIPTION

Figure 1:
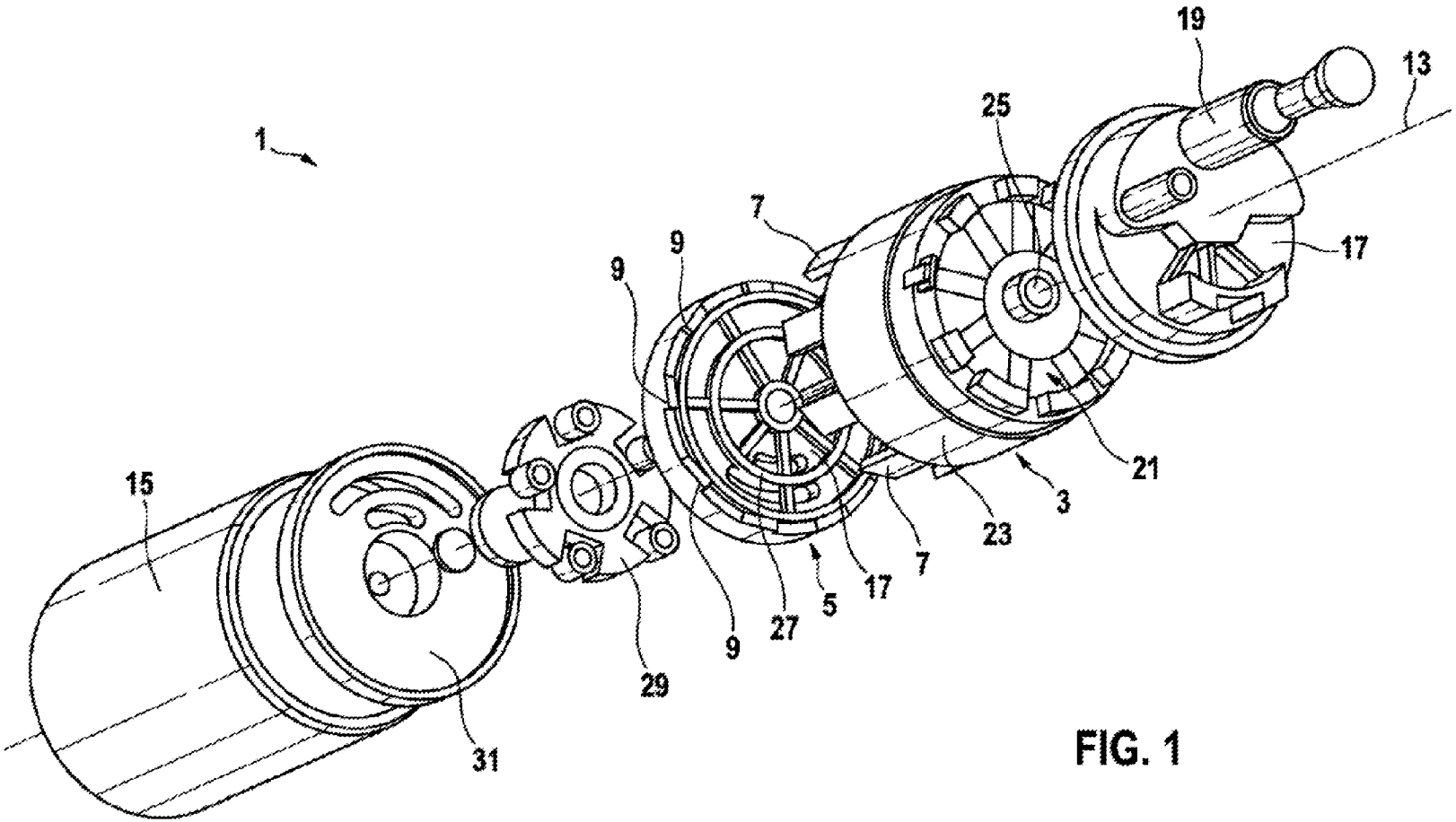
FIG. 1 illustrates components of an electric pump in accordance with an exemplary embodiment of the invention in an exploded view

All the figures are only schematic illustrations of devices in accordance with the invention or rather of their components in accordance with exemplary embodiments of the invention. In particular, spacings and size relations are not reproduced to scale in the figures. Corresponding elements are provided with identical reference numbers in the various figures.

In the exemplary embodiments that are illustrated in the figures, the electric pump 1 is embodied as an electric fuel pump for a motor vehicle. By way of example, the electric pump 1 can be suitable for arranging in a storage pot of a fuel tank or directly in the fuel tank.

The first pump component 3 is embodied in the figures as a housing 23 of an electric motor 21. In addition, the second pump component 5 is embodied as an intermediate housing 27. In addition or alternatively, the second pump component 5 can be embodied as a connecting cover 17.

However, in alternative embodiments that are not illustrated in the figures, it is possible for any inner components of the electric pump 1 that are adjacent to one another to function as the first pump component 3 and the second pump component 5. By way of example, the first pump component 3 can be embodied as a connection cover 17 and the second pump component 5 can be embodied as an electric motor 21 or as a housing 23 of the electric motor 21.

The electric pump 1 comprises a pump housing 15 for example made from steel. The inner components, in other words the pump components 3, 5 are arranged in the pump housing 15. In general, the pump components 3, 5 are stressed by way of the pump housing 15 so that said pump components assume defined positions in relation to one another. An axial force arises while closing the pump housing 15 for example by means of a flanging, beading or rolling process.

Over the serviceable life of the electric pump 1, it is possible for the pump components 3, 5 to settle and this can lead to a loss of the inner pre-stressing arrangement. This can be caused as a result of using different materials such as steel, aluminum and synthetic material for the individual pump components 3, 5. Furthermore, different coefficients of thermal expansion of the pump components 3, 5 can lead to an additional loosening of the pump components 3, 5 since for example synthetic materials such as the housing 23 of the electric motor 21 are generally more intensely compressed in comparison to steel, for example on the pump housing 15, in the case of lower temperatures.

In the case of conventional electric pumps, it can therefore be difficult also to ensure a pre-stressing arrangement of the components over the temperature changes that occur, for example in a motor vehicle. Due to the electric pump 1 in accordance with the invention as is illustrated in an exemplary manner in FIGS. 1 to 4, it is now possible while starting up the electric motor 21 in the case of pump components 3, 5 that are loosened from one another to rotate the inner components 3, 5 with respect to one another and to utilize this rotation so as by means of an incline 11 or rather a gradient to compensate for an occurring axial gap.

For this purpose, an incline 11 is provided on the first contact surfaces 7 at which the first pump component 3 is in contact with the second pump component 5.

By way of example, the pump components 3, 5 comprise in each case multiple connecting pieces that extend in the direction of the pump axis 13 and are distributed over the periphery, wherein the inclines 11 are embodied in each case at the connecting pieces of the pump components 3, 5 and wherein the inclines 11 of the pump components 3 cooperate with the inclines 11 of the pump components 5 in accordance with the invention. The incline 11 includes an angle $\alpha$ with respect to a plane that extends perpendicularly to a longitudinal axis 13 of the electric pump 1. This angle is for example illustrated in FIG. 3 and FIG. 4. The angle $\alpha$ can also be described as the angle of inclination and is preferably smaller than 5°. In addition, a second contact surface 9 having an incline that corresponds to the first incline 11 can be provided on the second pump component 5.

Figure 3:
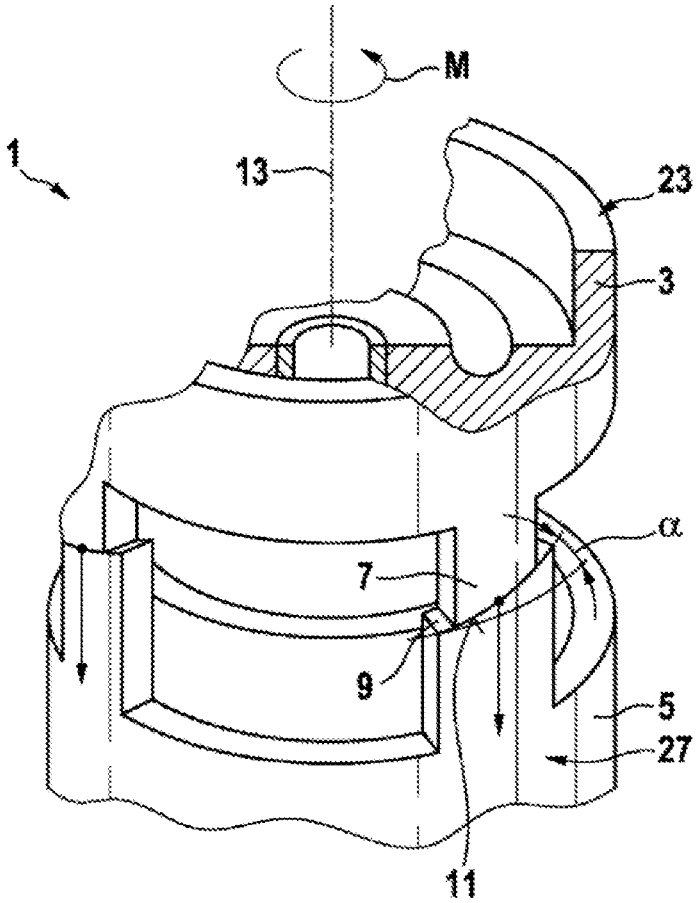
FIG. 3 illustrates a three-dimensional cut-away view of an electric pump in accordance with an exemplary embodiment of the invention
Figure 4:
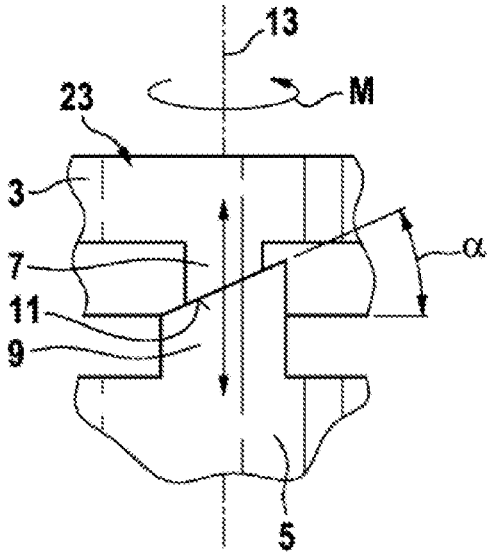
FIG. 4 illustrates a cross section through a first contact surface of an electric pump in accordance with an exemplary embodiment of the invention.

As a result of a torque M that is illustrated by means of an arrow in FIG. 3 and FIG. 4, the pump components 3, 5 can be rotated with respect to one another. The torque M is by way of example a counter torque with respect to the driving torque generated by the electric motor. In the case of rotating the pump components 3, 5 with respect to one another along the incline 11, it is possible to compensate for axial gaps, in other words gaps in the direction of the longitudinal axis 13. In addition, in the case of a suitable selection of geometry and materials, it is possible to fix the pump components 3, 5 by means of rotation with respect to one another. The incline 11 is aligned in such a manner that the counter torque with respect to the driving torque M closes the gap between the pump components 3, 5.

Figure 2:
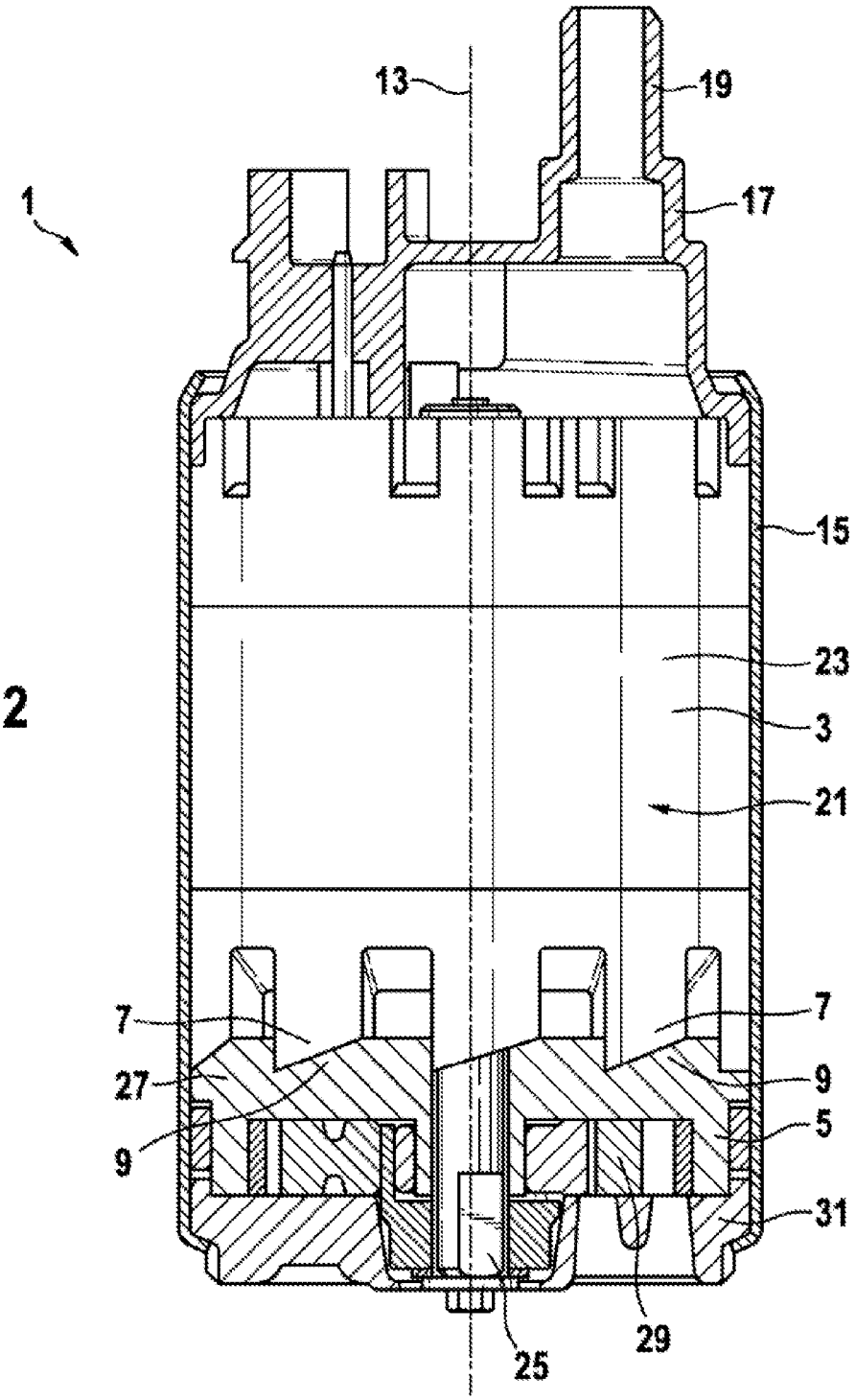
FIG. 2 illustrates a cross section through an electric pump in accordance with an exemplary embodiment of the invention

As is illustrated in FIG. 1 and FIG. 2, the electric pump 1 comprises a pump housing 15 that is made for example from steel. A suction cover 31 is arranged in the pump housing 15. The fluid that is to be conveyed, for example fuel, can pass through an opening in the suction cover 31 into the interior of the electric pump 1. A pump stage having a pump wheel 29 is arranged between the suction cover 31 and the intermediate housing 27 that comprises for example PPS. Chambers are provided in the pump wheel 29 and the fluid is transported in said chambers.

The pump housing 15 is closed on the upper side by means of a connecting cover 17 having an intake connecting piece 19. The fluid can be supplied by means of the intake connecting piece 19 for example by way of corrugated pipes to a consumer, such as for example an internal combustion engine.

An electric motor 21 is arranged between the connecting cover 17 and the intermediate housing 27. The electric motor 21 comprises a stator and a rotor. A shaft 25 of the electric motor 21 is connected to the pump wheel 29 in a non-rotatable manner and said shaft drives said pump wheel. The electric motor 21 and in particular the outer lying stator of the electric motor 21 can be injection molded using a synthetic material such as plyamide.

If axial gaps are present between the pump components 3, 5 and in particular between the intermediate housing 27 and the housing 23 of the electric motor 21, for example as a result of the materials relaxing, for example a startup torque M of the electric motor 21 is thus transferred to the pump components 3, 5 in such a manner that said pump components are rotated along the incline 11 until a self-locking arrangement occurs.

In conclusion it is noted that expressions such as "comprising" or similar are not to rule out that further elements or steps can be provided. Furthermore, it is to be noted that the use of the indefinite article 'a' does not rule out a plurality. In addition, it is possible in connection with the various embodiments to combine described features with one another in an arbitrary manner. In addition, it is noted, that the reference numerals in the claims are not to be seen as limiting the scope of the claims.

What is claimed is:

1. An electric pump (1) for conveying a fluid, the electric pump (1) comprising an electric motor (21) that generates a driving torque, a first pump component (3) having a plurality of first connecting pieces distributed over a periphery of the first pump component (3), wherein each of the first connecting pieces extends in a direction parallel to a longitudinal axis (13) of the electric pump (1) and each includes a first contact surface (7), wherein each of the first contact surfaces (7) has an incline (11) with respect to a plane that extends perpendicularly to the longitudinal axis (13) of the electric pump (1), wherein the first pump component (3) is a housing (23) of the electric motor (21), and a second pump component (5) having a plurality of second connecting pieces distributed over a periphery of the second pump component (5), wherein each of the second connecting pieces extends toward the first pump component 3 in a direction parallel to the longitudinal axis (13) of the electric pump (1) and each includes a second contact surface (9), wherein each of the second contact surfaces (9) has an incline that corresponds to the incline of the first contact surface (7), wherein the first pump component (3) and the second pump component (5) are in contact with one another at the first and second contact surfaces (7, 9), wherein the inclines (11) of the first pump component (3) cooperate with the inclines of the second pump component (5), and wherein the inclines of the first and second pump components (3, 5) are aligned such that a gap between the first and second pump components (3, 5) is closed when a counter torque (M) with respect to the driving torque is applied.

2. The electric pump (1) as claimed in claim 1, wherein the first pump component (3) is configured to generate the counter torque (M), wherein the counter torque (M) causes the first pump component (3) to rotate with respect to the second pump component (5).

3. The electric pump (1) as claimed in claim 2, wherein the counter torque and the incline (11) cause an overall length of the first pump component (3) and the second pump component (5) to be constant along the longitudinal axis (13) of the electric pump (1).

4. The electric pump (1) as claimed in claim 1, wherein the incline (11) is configured such that a frictional lock arises at the first contact surface (7) in the case of a rotation of the first pump component (3) with respect to the second pump component (5).

5. The electric pump (1) as claimed in claim 1, wherein the second pump component (5) is an intermediate housing (27), and wherein the second pump component (5) is arranged between the housing (23) of the electric motor (21) and a pump wheel (29).

6. The electric pump (1) as claimed in claim 3, wherein the incline (11) is configured such that a frictional lock arises at the first contact surface (7) in the case of a rotation of the first pump component (3) with respect to the second pump component (5).

7. The electric pump (1) as claimed in claim 6, wherein the second pump component (5) is an intermediate housing (27), and wherein the second pump component (5) is arranged between the housing (23) of the electric motor (21) and a pump wheel (29).

* * * * *